US006168508B1

(12) United States Patent
Nagahara et al.

(10) Patent No.: US 6,168,508 B1
(45) **Date of Patent: *Jan. 2, 2001**

(54) POLISHING PAD SURFACE FOR IMPROVED PROCESS CONTROL

(75) Inventors: Ronald J. Nagahara, San Jose; Dawn M. Lee, Morgan Hill, both of CA (US)

(73) Assignee: LSI Logic Corporation, Milpitas, CA (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/918,293

(22) Filed: Aug. 25, 1997

(51) Int. Cl.[7] ..... B24D 11/00
(52) U.S. Cl. ..... 451/527; 451/285
(58) Field of Search ..... 451/57, 41, 28, 451/36, 37, 42, 63, 60, 285, 287, 288, 259, 274, 921, 526, 528–529, 539, 538, 527

(56) References Cited

U.S. PATENT DOCUMENTS 5,245,790 9/1993 Jerbic .
5,265,378 11/1993 Rostoker .
5,310,455 5/1994 Pasch et al. .
5,321,304 6/1994 Rostoker .
5,389,194 2/1995 Rostoker et al. .
5,403,228 4/1995 Pasch .
5,516,400 5/1996 Pasch et al. .
5,624,304 4/1997 Pasch et al. .
5,626,715 5/1997 Rostoker .
5,667,433 9/1997 Mallon .
5,861,055 1/1999 Allman et al. .
5,865,666 2/1999 Nagahara .
5,868,608 2/1999 Allman et al. .
5,882,251 3/1999 Berman et al. .
5,888,120 3/1999 Doran .
5,893,756 4/1999 Berman et al. .
5,948,697 9/1999 Hata .
5,957,757 9/1999 Berman .

*Primary Examiner*—Derris H. Banks

(57) ABSTRACT

A polishing pad for chemical-mechanical polishing of an integrated circuit surface is described. The polishing pad includes a first polishing area having a first value of a physical property; and a second polishing area having a second value of said physical property, which said second value is different from the first value, such that during chemical-mechanical polishing of an integrated circuit surface, the integrated circuit rotates and oscillates on the polishing pad so that a substantial portion of the integrated circuit surface contacts both the first and second polishing areas, wherein a width of said first and second polishing areas is greater than about 40 mils.

25 Claims, 8 Drawing Sheets

POLISHING PAD SURFACE FOR IMPROVED PROCESS CONTROL

BACKGROUND OF THE INVENTION

The present invention relates to a modified polishing pad design for use in chemical-mechanical polishing (sometimes referred to in the art as "CMP") of integrated circuits (ICs). More particularly, the present invention relates to a polishing pad having a surface, which includes at least two different polishing areas that contact a substantial portion of a wafer surface during chemical-mechanical polishing (CMP) to produce a more uniformly polished and a more planar integrated circuit (IC) surface.

CMP typically involves mounting an IC, such as a semiconductor wafer, face down on a holder and rotating the wafer face against a polishing pad mounted on a platen, which in turn rotates or orbits about an axis. A slurry containing a chemical that chemically interacts with the facing wafer layer and an abrasive that physically removes that layer is flowed between the wafer and the polishing pad or on the pad near the wafer.

In semiconductor wafer fabrication, this technique is commonly applied to planarize various wafer layers such as dielectric layers, metallization layers, etc. By way of example, by subjecting a blanket deposited metal layer on the wafer surface to CMP, the metal layer on a dielectric surface is removed and the metal layer remaining inside a contact hole or a via forms a metal plug inside the dielectric layer. As is well known in the art, contact holes and vias are openings in the dielectric layer that surround a contact to an underlying substrate layer or a metallization layer, respectively, disposed below the dielectric surface.

Polishing pads used in CMP have different characteristics, such as hardness, specific gravity, compressibility, etc., which offer different advantages and are therefore employed in different applications. Unfortunately, these advantages are typically realized at the expense of other undesirable effects. By way of example, a polishing pad made from a hard material, such as polyurethane, offers better planarity of the wafer surface and a high film removal rate at the expense of producing a highly scratched wafer surface, which often requires further polishing on a soft polishing pad in a separate buffing or fine polishing step. This translates into a lower wafer throughput for the wafer CMP process.

As another example, a polishing pad made from a soft material, such as polyurethane impregnated felt, conforms to the wafer surface to a greater extent than a hard polishing pad and produces a relatively scratch-free and uniformly polished wafer surface, which is realized at the expense of slow film removal rate and "dishing" on some local feaatures of the wafer surface. The undesirable result of dishing is explained hereinafter in the context of tungsten CMP to form tungsten plugs. As used herein, the terms "uniform" and "uniformly polished," and variation thereon refer to local flatness assessed at individual die on a wafer surface. In contrast, "planar" surfaces are flat over the entire wafer surface (spanning multiple die). Thus, while a particular polishing system may produce a highly "uniform" surface (as determined by evaluating individual die), it may produce a particularly non-planar surface. In other polishing systems, the opposite may be true.

Film removal during tungsten CMP is more of a chemical process than a mechanical process. The slurry introduced on the polishing pad surface during CMP includes a reactive component, e.g., an oxidizing agent, and abrasive particles. Basically, the oxidizing agent which may be ferric nitrate ($Fe(NO_3)_3$) reacts with the tungsten to form tungsten oxide, which is abraded during CMP by the action of abrasive particles that typically include silica or alumina particles. The soft polishing pad is desirable for film removal in this context because it acts like a sponge and under pressure during wafer CMP, it almost uniformly releases the absorbed slurry on the wafer surface. As a result, the tungsten layer is nearly uniformly oxidized throughout the wafer surface and a uniform film removal rate is realized. Upon inspection of the tungsten plug surface, after CMP, under a microscope, however, formation of an indentation or a recess shaped like a dish is observed on the tungsten plug surface. Thus, the tungsten plug surface is referred to as suffering from dishing. Dishing is undesirable because it lowers the conductivity of the plug and sometimes to the point of causing a catastrophic device failure.

In order to offset the effects of dishing, the wafer surface is subjected to buffing or fine polishing, in a separate step after (coarse) CMP, typically on an even softer polishing pad. During fine polishing, a slurry composition tailored to remove the dielectric layer surrounding the plug is introduced so that after fine polishing, the plug protrudes slightly above the dielectric layer surface. Thus, the fine polishing step that follows the (coarse) CMP step corrects for dishing of the tungsten plug surface. As mentioned before, the additional fine polishing step lowers the throughput of the wafer CMP process.

What is therefore needed is a polishing pad that provides the advantages of the conventional polishing pad materials without incurring the expense of their undesirable effects.

SUMMARY OF THE INVENTION

To achieve the foregoing, the present invention provides a polishing pad for chemical-mechanical polishing of an integrated circuit surface. The polishing pad includes: (1) a first polishing area having a first value of a physical property; and (2) a second polishing area having a second value of the physical property which second value is different from the first value, such that during chemical-mechanical polishing of an integrated circuit surface, the integrated circuit rotates and oscillates on the polishing pad so that a substantial portion of the integrated circuit surface contacts both the first and second polishing areas, wherein a width of the first and second polishing areas is greater than about 40 mils.

The width of the first and second polishing areas preferably ranges from about 0.08 and about 3 inches and more preferably ranges from about 0.25 and about 3 inches. Microgrooves and microgrooves, in contrast, have a much smaller width, e.g., about 15 and about 40 mils, compared to the width of first and second polishing areas.

The term "physical property" of an area on the polishing pad refers to such surface characteristics as hardness, specific gravity, compressibility, abrasiveness, the height of the polishing area, etc. The first polishing area may have a hardness that is greater than the second polishing area. The rockwell hardness of the first polishing area may be between about 30 and about 90 Shore A.

The first polishing area may be more compressible than the second polishing area. The compressibility of the first polishing area is between about 2 and about 50%. The specific gravity of the first polishing area is between about 0.6 and about 1.5.

The first polishing area may include abrasive particles and the second polishing area may not include abrasive particles. The first polishing area may protrude from a surface of the polishing pad and relative to the second polishing area. The first polishing area may protrude relative to the second polishing area by a distance that ranges from between about 5 mils to about 100 mils. The first and second polishing areas includes at least one material selected from the group consisting of polyurethane, urethane, polymer, polyurethane impregnated felt, abrasive and filler material.

In another aspect, the present invention provides a polishing pad for chemical-mechanical polishing of an integrated circuit surface. The polishing pad includes (1) a center polishing area disposed towards a center of a surface of the polishing pad and having a first value of a physical property, (2) a peripheral polishing area located at the edge of the polishing pad having the first value of the physical property; and (3) a ring shaped polishing area defined by an inner boundary and an outer boundary and located between the center polishing area and the peripheral area, wherein the ring shaped polishing area has a second value of the physical property which second value is different from the first value of the peripheral and the center polishing areas and during chemical-mechanical polishing of an integrated circuit surface, the integrated circuit rotates and oscillates on the polishing pad so that a substantial portion of the integrated circuit surface contacts at least the ring shaped polishing area and the peripheral or the center polishing areas, wherein a width of the ring shaped polishing area, the peripheral polishing area and the center polishing area is greater than about 40 mils.

A distance between the outer boundary and the inner boundary of the ring shaped polishing area may be less than or equal to a diameter of the integrated circuit surface. The ring shaped polishing area may be made from a first polishing pad material and the peripheral and the center polishing areas are made from a second polishing pad material.

The polishing pad surface mentioned above may further include an intermediate polishing area and another ring shaped polishing area, wherein the another ring shaped polishing area is disposed between the center and peripheral polishing areas and the intermediate polishing area separates the ring shaped polishing area and the another ring, shaped polishing area. Furthermore, the circular ring shaped polishing area may be made from first polishing pad material, the peripheral and the center polishing areas may be made from second polishing pad material and the intermediate polishing area is made from a third polishing pad material and during chemical-mechanical polishing of the integrated circuit surface, a substantial portion of the integrated circuit surface contacts the first, second and third polishing materials of the polishing pad.

In the polishing pad of this embodiment, during CMP, the polishing pad and the integrated circuit may rotate around an axis that passes through the center of the surface of the integrated circuit so that the integrated circuit is polished on a wafer track, which include at least a portion of the ring shaped polishing area and the peripheral or the center polishing areas.

In yet another aspect, the present invention provides a polishing pad for chemical-mechanical polishing of an integrated circuit surface. The polishing pad includes (1) a center polishing area disposed at a center region of the polishing pad and having a first value of a physical property; and (2) a peripheral polishing area located outside the center polishing area and having a second value of the physical property that is different from the first value of the physical property of the center polishing area and during chemical-mechanical polishing of an integrated circuit surface, the integrated circuit rotates and oscillates on the polishing pad so that a substantial portion of the integrated circuit surface contacts the center and peripheral polishing areas, wherein a width of the first and second polishing areas is greater than about 40 mils.

In this embodiment, the polishing pad may have a plurality of slurry injection holes, macrogrooves and microgrooves. During CMP, the integrated circuit may rotate on a polishing pad, which may orbit around an axis that is perpendicular to the polishing pad surface, so that the integrated circuit is polished on the polishing pad near a center region, which includes at least a portion of the peripheral and the center polishing areas. The center region may have a diameter that is between about 1 and about 12 inches.

In yet another aspect, the present invention provides a chemical-mechanical polishing process for polishing an integrated circuit. The process includes providing a polishing pad having (1) a first polishing area having a first value of a physical property; and (2) a second polishing area having a second value of the physical property which the second value is different from the first value and a width of the first and second polishing areas is greater than about 40 mils. The process further includes securing the integrated circuit on a wafer holder, contacting an active surface of the integrated circuit face down on the polishing pad and polishing the active surface such that the integrated circuit rotates and oscillates on the polishing pad so that a substantial portion of the integrated circuit surface contacts both the first and second polishing areas of the polishing pad.

In the step of polishing, the wafer may oscillate from one side of the wafer to a second side of the wafer by a distance that is between about 0.25 and about 12 inches.

These and other features of the present invention will be described in more detail below in the detailed description of the invention and in conjunction with the following figures.

DETAILED DESCRIPTION OF THE PREFERRED EMBODIMENTS

Figure 1A:
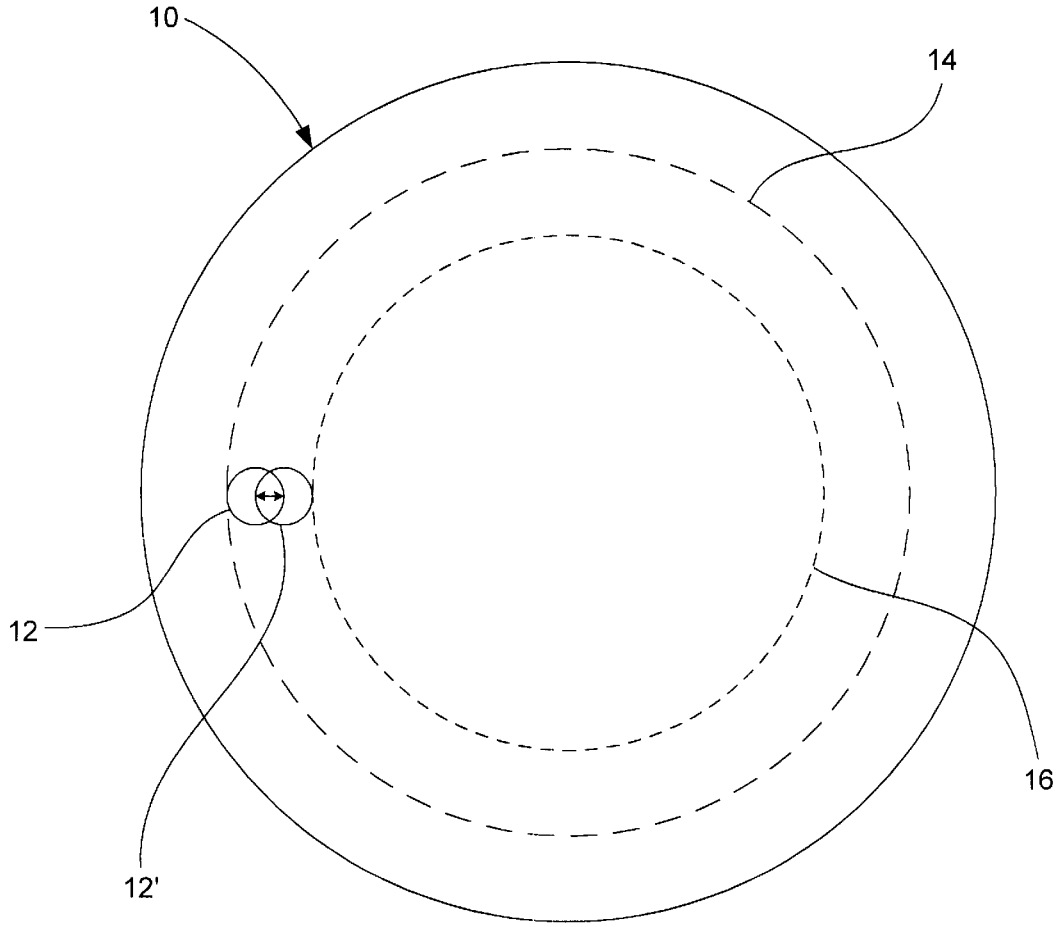
FIG. 1A shows a top view of a surface of a rotating polishing pad employed in a conventional chemical-mechanical polishing (CMP) system to polish a wafer.

The present invention provides a polishing pad surface, which includes at least two different polishing areas that contact a substantial portion of a wafer surface during chemical-mechanical polishing (CMP) to produce a more uniformly polished and a more planar integrated circuit (IC) surface. In the following description, numerous specific details are set forth in order to fully illustrate a preferred embodiment of the present invention. It will be apparent, however, that the present invention may be practiced without limitation to some specific details presented herein.

The present invention provides at least two different polishing areas, i.e. a first polishing area and a second polishing area, on a same surface of a polishing pad. The first polishing area has at least one physical property that is different from that of the second polishing area. Physical property of an area on the polishing pad surface refers to such polishing pad characteristics as hardness, specific gravity, compressibility, abrasiveness, the height of the polishing area, etc. In one embodiment, the first and second polishing areas of the present invention may be made from substantially similar polishing pad materials, but they may have a physical property that is different. By way of example, both the first and second polishing areas of the polishing pad surface may be made from a compressible polishing pad material, but the first polishing pad material may be relatively more compressible than the second polishing pad material. In another embodiment, the first and second polishing areas of the present invention are made from different polishing pad materials having totally different physical properties.

During chemical-mechanical polishing (CMP), a substantial portion of the rotating, oscillating wafer surface contacts both the first and second polishing areas of the polishing pad surface and thereby derives the benefits offered by the physical properties of these areas. Those skilled in the art will recognize that polishing pads currently employed in CMP systems have substantially uniform physical properties throughout the polishing pad surface.

The polishing pad, according to the present invention, may include one or more first polishing areas that have substantially similar physical properties and one or more second polishing areas that have substantially similar physical properties. At least one physical property of the first polishing areas, however, must be different from that of the second polishing areas. In one embodiment, the first polishing area of the present invention may be a single annular area (ring shaped) area concentrically positioned on the polishing pad surface between a center and a peripheral area. The center and peripheral areas may define the second polishing areas of the polishing pad. Alternatively, instead of a single annular area, the present invention may include a plurality of narrow annular areas separated by intermediate areas and disposed between the center and peripheral area of the polishing pad.

In another embodiment of the present invention, the first polishing area includes a circular center area that may be disposed towards the center of the polishing pad and the second polishing area includes an annular shaped peripheral area located outside toward the edge of the pad. In a variation of this embodiment, the first polishing area includes at least one annular ring shaped area disposed inward from the pad edge and a relatively small center area at the pad center. The second polishing area of this embodiment may include a peripheral area and at least one intermediate area, which separates the center and circular area.

In order to fully appreciate how the different polishing areas of the present invention provide a more planar and uniformly polished wafer surface, it should be kept in mind that the location of the different polishing areas depend on a "duty cycle," which in the chemical-mechanical polishing (CMP) art refers to an amount of time that the wafer spends on a certain area of the polishing pad during CP. The term "high duty cycle," as used in connection with the description of this invention, means that a substantial amount of polishing time is spent on a certain area of the polishing pad during CMP.

The duty cycle generally depends on whether a conventional CMP system or a modern CMP system is employed. By way of example, in the conventional CMP systems, a circular wafer track area, which is located between a center area and the edge of a polishing pad, experiences a higher duty cycle and in the modern CMP systems an area near the center of the polishing pad experiences a higher duty cycle. In order to facilitate a clear understanding of why the location of the higher duty cycle varies from the polishing pad used in conventional CMP systems to those used in modern CMP systems, a detailed description of the conventional and modern CMP systems is set forth below.

In a conventional CMP system, such as an Avanti 472, commercially available from Integrated Processing Equipment Corporation (IPEC) of Phoenix, Ariz., the polishing pad rotates during CMP. FIG. 1A shows a wafer 12 undergoing CMP on a surface of a rotating polishing pad 10 used in a conventional CMP system. Polishing pad 10 rotates around an axis that passes through the center point of the polishing pad surface. Although it is not necessary, wafer 12 and polishing pad 10 may rotate in the same direction. A rotating wafer 12 carves out on polishing pad 10 a wafer track area, which is defined by an inner boundary 16 and an outer boundary 14. Those skilled in the art will recognize that the width of the wafer track area might be larger than the diameter of the wafer because during CMP, the rotating wafer also oscillates from side to side in a radial direction of the polishing pad. FIG. 1A shows a wafer 12 in its displaced, oscillating position 12'. Thus, in the conventional CMP systems, the wafer track area of the polishing pad experiences a higher duty cycle than other areas of the polishing pad.

Figure 1B:
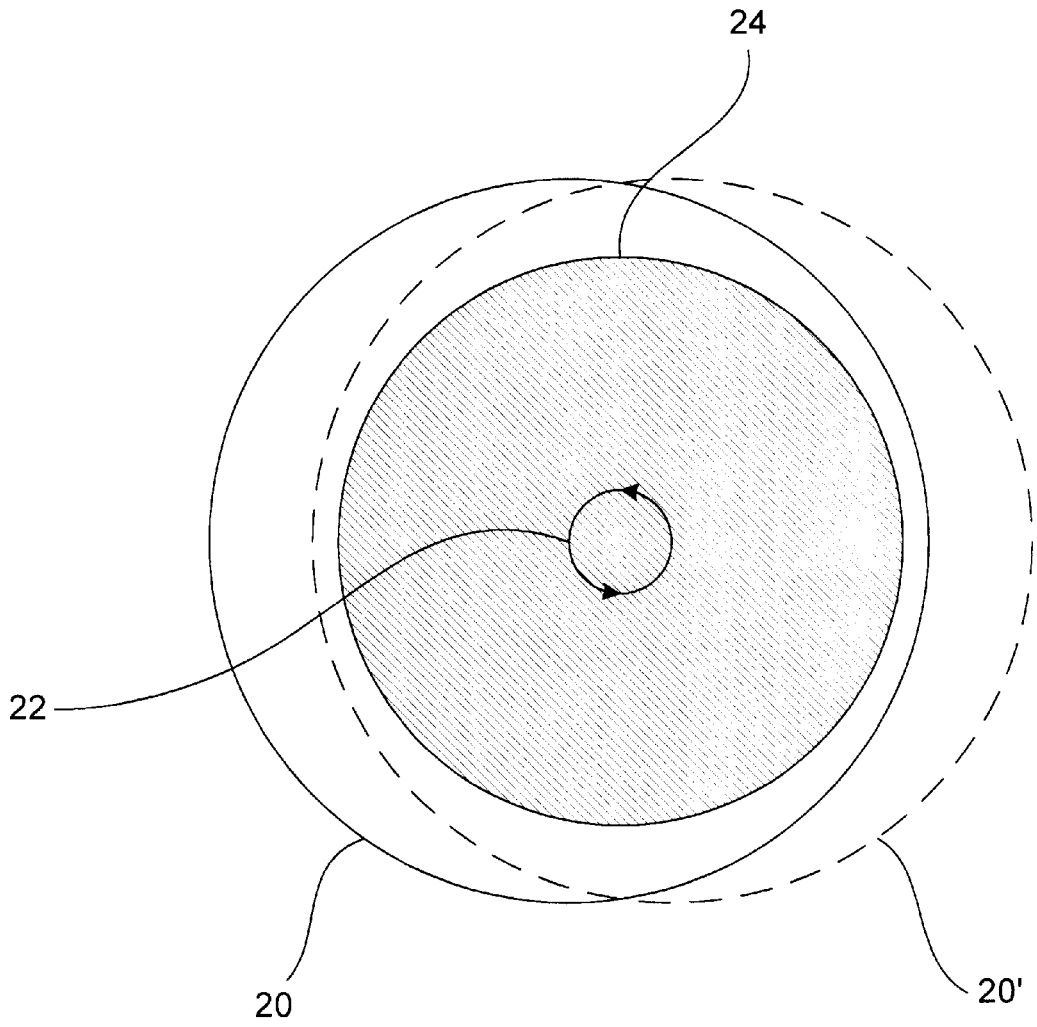
FIG. 1B shows a top view of a surface of an orbiting polishing pad employed in a modem chemical-mechanical polishing (CMP) system to polish a wafer.

In a modern CMP system, such as the AvantGaard 676, also commercially available form Integrated Processing Equipment Corporation (IPEC) of Phoenix, Ariz., the polishing pad does not rotate, but orbits around an axis that is perpendicular to the polishing pad surface. FIG. 1B shows a polishing pad 20 in its orbital state and for exemplary purposes, reference number 20' denotes one position of polishing pad 20 as it orbits around an axis that is perpendicular to the polishing pad surface. In other words, during the orbital motion of the polishing pad, a center-point 22 of polishing pad 20 moves in a circular path, as shown in FIG. 1B. A wafer 24 subjected to CMP on orbiting polishing pad 20 is positioned off-center, i.e. the center-point of wafer 24 does not coincide with the center-point of polishing pad 20, but is near to the center-point of polishing pad 20. It should be noted, however, that wafer 24 does not carve out a wafer track area An the polishing pad as it does in the conventional CMP systems described above. In the modem CMP systems, therefore, the center area of the polishing pad experiences a higher duty cycle than peripheral areas of the polishing pad.

Those skilled in the art will recognize that the surface of polishing pad 20 has macrogrooves and slurry injection holes (both not shown to simplify illustration) to facilitate slurry distribution on the polishing pad surface and microgrooves (not shown to simplify illustration) to provide slurry to the wafer-polishing pad interface during CMP.

Figure 2A:
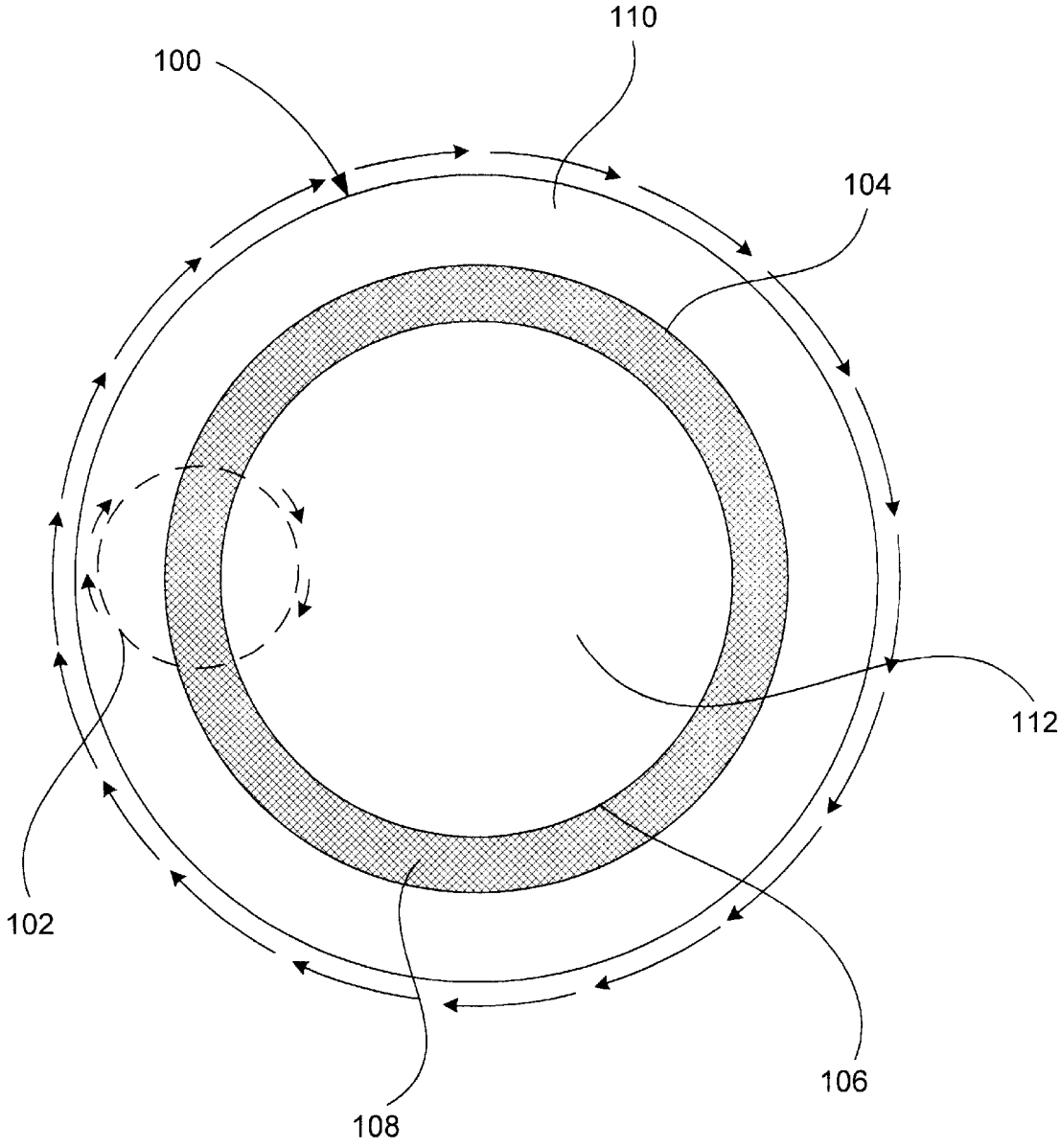
FIG. 2A shows a top view of a polishing pad surface, according to one embodiment of the present invention, that is preferably employed in conventional CMP systems.

In a preferred embodiment of the present invention, the polishing pads shown in FIGS. 2A and 2B and described below are employed in conventional CMP systems, such as the Avanti 472. FIG. 2A shows a polishing pad 100, according to one embodiment of the present invention, that may be employed in conventional CMP. A wafer 102 contacts a ring shaped interior annular area 108 disposed between a center area 112 and a peripheral area 110 of the polishing pad. The annular area 108 has a circular outer boundary 104 and a circular inner boundary 106, both of which are concentrically positioned on the polishing pad surface. Wafer 102 also contacts portions of areas 110 and 112.

Figure 2B:
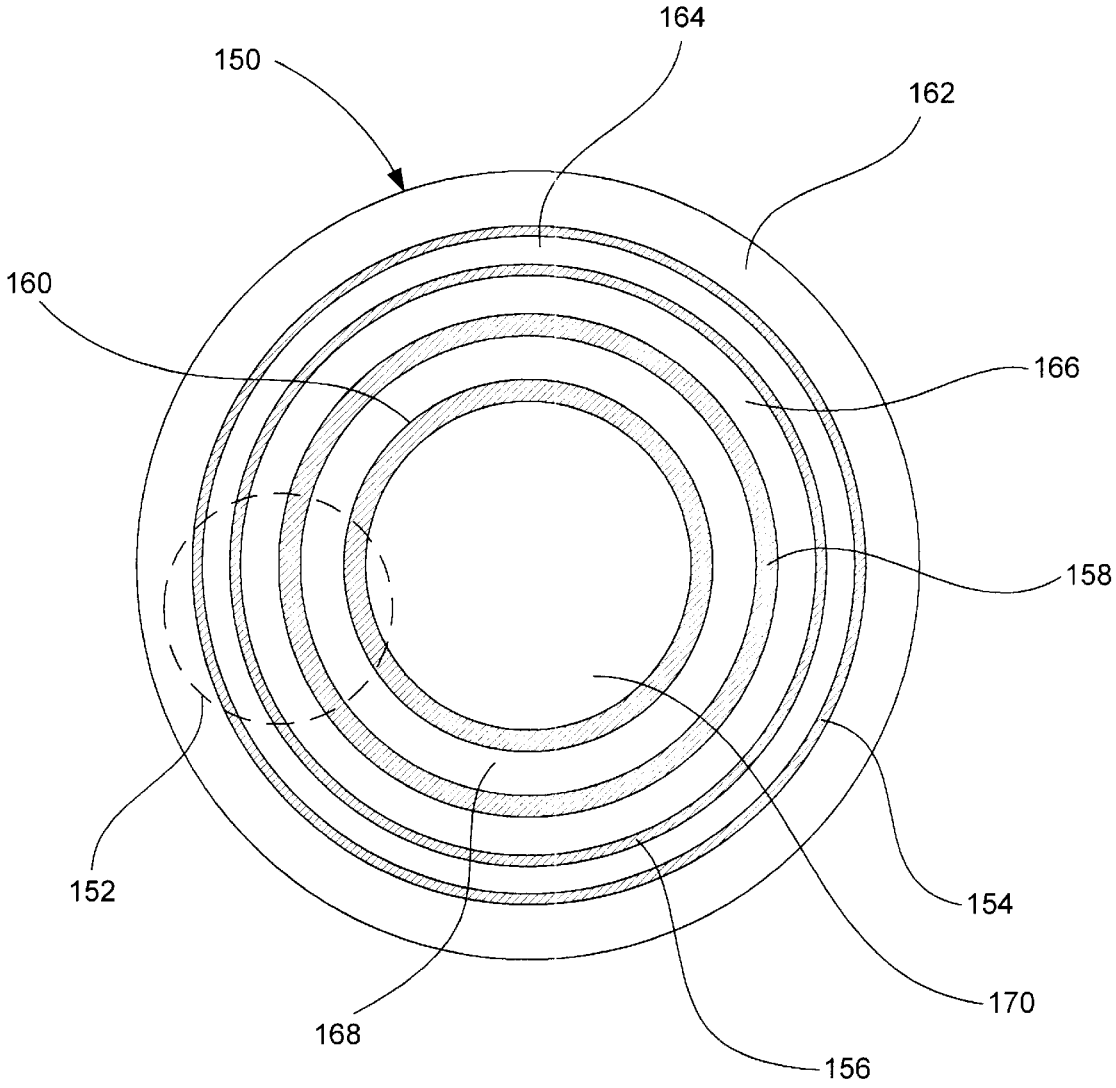
FIG. 2B shows a top view of a polishing pad surface, which is a variation of the polishing pad surface of FIG. 2A and may also be employed in conventional CMP systems.

FIG. 2B shows a polishing pad 150, which is a variation of the embodiment of FIG. 2A. In the embodiment of FIG. 2B, instead of one interior annular area, a wafer 152, during CMP, contacts a plurality of interior annular areas 154, 156, 158 and 160 located between a center area 170 and a peripheral area 162 and these annular areas are separated by intermediate annular areas 164, 166 and 168.

According to one embodiment, the interior annular areas shown in FIGS. 2A and 2B may have at least one physical property that is different from that of the center and peripheral areas of FIGS. 2A and 2B. Additionally, in the embodiment of FIG. 2B, the first interior annular areas (154, 156, 158 and 160) may have at least one physical property that is different from that of the second annular areas (164, 166 and 168).

As used herein, the term "physical property" of an area on the polishing pad refers to such surface characteristics as hardness, specific gravity, compressibility, abrasiveness, the height of the polishing area, etc. By way of example, the regions defined as belonging to the "first" areas may all be made from the same soft polishing pad material, but the regions belonging to the "second" areas may be made from the same hard polishing pad material. Also, the first areas may include abrasive particles and the second areas may not have abrasive particles.

In the embodiment where abrasive particles are present in some areas but not others, a substantial portion of a wafer surface contacts both the abrasive and non-abrasive polishing pad surface during wafer CMP. Thus, according to the present invention, the wafer derives the benefit of high polishing rates offered by the abrasive surface and the benefit of buffing or fine polishing offered by the non-abrasive, soft surface from the same polishing pad in a single polishing step. As a result, a separate fine polishing step that may follow a CMP step is eliminated, and the wafer throughput is thereby increased. Furthermore, the cost of providing a separate polishing pad for fine polishing is also eliminated.

As mentioned, some areas may be composed of a hard polishing pad material, while other areas may be composed of a soft polishing pad material. In this embodiment, a substantial portion of the wafer surface that contacts both the hard and soft polishing pad surface during wafer CMP, according to the present invention, derives the benefit of a high polishing rate and a more planarized wafer surface offered by the hard polishing pad material, without degrading surface quality due to the presence of a soft polishing pad material. Furthermore, the wafer surface also derives the benefits of undergoing fine polishing or buffing and nearly uniform polishing rate offered by the soft polishing pad material, without suffering from dishing due to the presence of a hard polishing pad material. Consequently, the need for a separate fine polishing step to offset the effects of dishing and a separate polishing pad to carry out fine polishing is eliminated.

As yet another example, a first polishing pad material in the first areas may be made from a material that does not require pad conditioning, e.g., Suba 500 commercially available from Rodel, and a second polishing pad material in the second areas may include a material that is harder or includes abrasive particles. "Pad conditioning" is performed on the polishing pad surface to roughen up the pact by introducing microgrooves and macrogrooves thereon.

Those skilled in the art will, therefore, recognize that the polishing pad design of the present invention includes many combinations of polishing pad materials with different physical properties on the same polishing pad. It should be kept in mind that the physical properties mentioned above are intended as examples and should not be construed to limit the scope of the present invention. Other examples of polishing pad physical properties include pore size, pad elastic and shear modulus, pad perforations, etc.

In the embodiments described above at least two different polishing areas are positioned near the wafer track area, which experiences a higher duty cycle in the conventional CMP systems. In the polishing pad surface shown in FIG. 2A, at least a portion of the center and peripheral areas are positioned in the wafer track area and in the polishing pad surface shown in FIG. 2B, at least a portion of the circular, center and peripheral areas are positioned in the walter track area. Thus, a rotating and oscillating wafer surface during CMP is displaced on the polishing pad by a sufficient amount so that a substantial portion of the wafer surface contacts at least two different polishing areas. Therefore, the present invention is able to provide the advantages of different polishing pad physical properties on the same polishing pad.

The hardness of a polishing pad is typically measured in relative units based on the type and mode of indentation employed and generally indicates the ability of the polishing pad to maintain its shape. In the present invention, a hard polishing pad material may have a rockwell hardness that is between about 30 and about 90 Shore A. In a preferred embodiment, hard polishing pad material includes at least one material selected from the group consisting of polyurethane, urethane, polymer and a filler material. By way of example, the polishing pad material in an IC-1000, commercially available from Rodel of Newark, Del. works well as a hard polishing pad material. A soft polishing pad material may preferably include materials like polyurethane impregnated felt or felt. The polishing pad material in Suba 500 (mentioned above), for example, works well as a soft polishing pad material.

Specific gravity of a polishing pad is determined at least in part by the porosity of the polishing pad. Pores in the polishing pad are important because they aid in slurry transport and in the removal of reaction products from the polish site. The specific gravity of the polishing pad material employed in the present invention may vary between about 0.6 and about 1.5 grams/$cm^3$.

Pad compressibility dictates how the polishing pad conforms to the wafer surface undergoing polishing. In order to obtain a polishing rate that is uniform across the wafer surface, the polishing pad must conform to the wafer surface on a long range scale. A relatively highly compressible polishing pad material employed in the present invention may vary between about 2 and about 50.

As used in connection with the description of this invention, the word "abrasiveness" refers to whether the polishing pad surface includes abrasive particles or not. The most commonly used abrasive particles for polishing a metal layer are alumina and silica particles and for polishing a silicon dioxide layer is silica particles. Other examples of abrasive particles include ceria ($CeO_2$), titania ($TiO_2$), magnesium oxide (MgO), zirconia ($ZrO_2$), rouge ($Fe_3O_4$), hafnia ($HfO_2$), etc. Typically the mean abrasive particle size distribution is between about 20 and about 150 nm. Two areas of a polishing pad may be distinguished by how much abrasiveness they have per unit surface area. Thus, for example, a less abrasive area may have (1) no abrasive particles; (2) a lower concentration of abrasive particles than other areas, or (3) abrasive particles that are less abrasive than particles in other areas.

The height of a polishing material refers to the distance by which the polishing pad surface is raised. The height of the polishing pad area affect the transport of the slurry and reaction products and local pressure gradients at the wafer surface. The heights of the first and second areas of the polishing pad may vary by as much as 100 mils in one embodiment. The heights of the first and second areas of the polishing pad may vary by as much as 100 mils in one embodiment. For example, a first area of the pad may be 105 mils thick and a second area of the pad may be between about 5 and about 205 mils thick. In another preferred embodiment, a first area is about 50 mils thick and second area is between about 5 mils and about 100 mils.

In the embodiment of FIG. 2A, the distance between circular outer boundary 104 and a circular inner boundary 106 is generally smaller than the wafer diameter to ensure that during CMP a substantial portion of a rotating, oscillating wafer surface contacts both the interior annular area 108 and center area 112 or peripheral area 110 of the polishing pad. For a wafer diameter that is between about 6 inches and about 12 inches, the distance between inner boundary 106 and outer boundary 104 is preferably between about 0.25 and about 11 inches.

The distances between similar inner and outer boundaries of plurality of interior annular areas 154, 156, 158 and 160 in FIG. 2B are preferably relatively smaller than those of the singular interior annular area of FIG. 2A. Those skilled in the art will recognize that the distance between the inner and outer boundaries of the interior annular areas of FIG. 2B may vary and the distances between the interior annular areas may also vary. In other words, the width of intermediate areas 164, 166 and 168 of FIG. 2B may also vary. By way of example, a distance between the inner and outer boundary of any interior annular area of FIG. 2B may be between about 0.25 and about 11 inch. It is preferable to employ the polishing pad shown in FIG. 2B in those instances where the wafer does not oscillate by a sufficient distance because the presence of plurality of narrow interior annular areas separated by intermediate annular areas at the wafer track area ensure that a substantial portion of the wafer surface contacts both polishing areas of the pad.

Intermediate annular areas 164, 166 and 168 of FIG. 2B may be made from the same material as the center or peripheral areas or alternatively, depending on the application for which the polishing pad is designed, they may be made from a different polishing pad material.

It is important to note that although areas with different physical properties are shown to have rounded shapes in FIGS. 2A, 2B, 3A and 3B, those skilled in the art will recognize that such areas, e.g., circular, center or peripheral areas, may be of different shapes if a polishing pad moves in linear motion as opposed to moving in an orbital or a rotational motion during polishing.

Figure 3A:
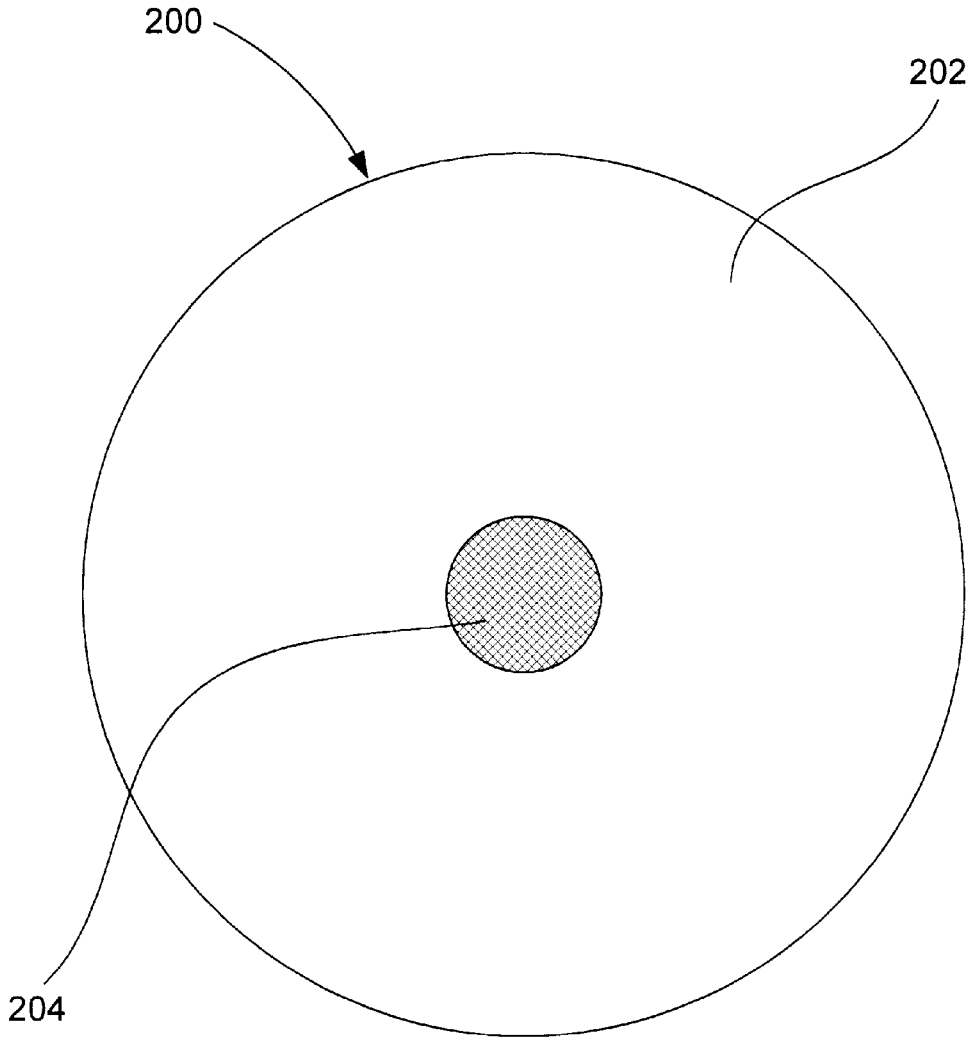
FIG. 3A shows a top view of a polishing pad surface, according to one embodiment of the present invention, that may be employed in modem CMP systems.
Figure 3B:
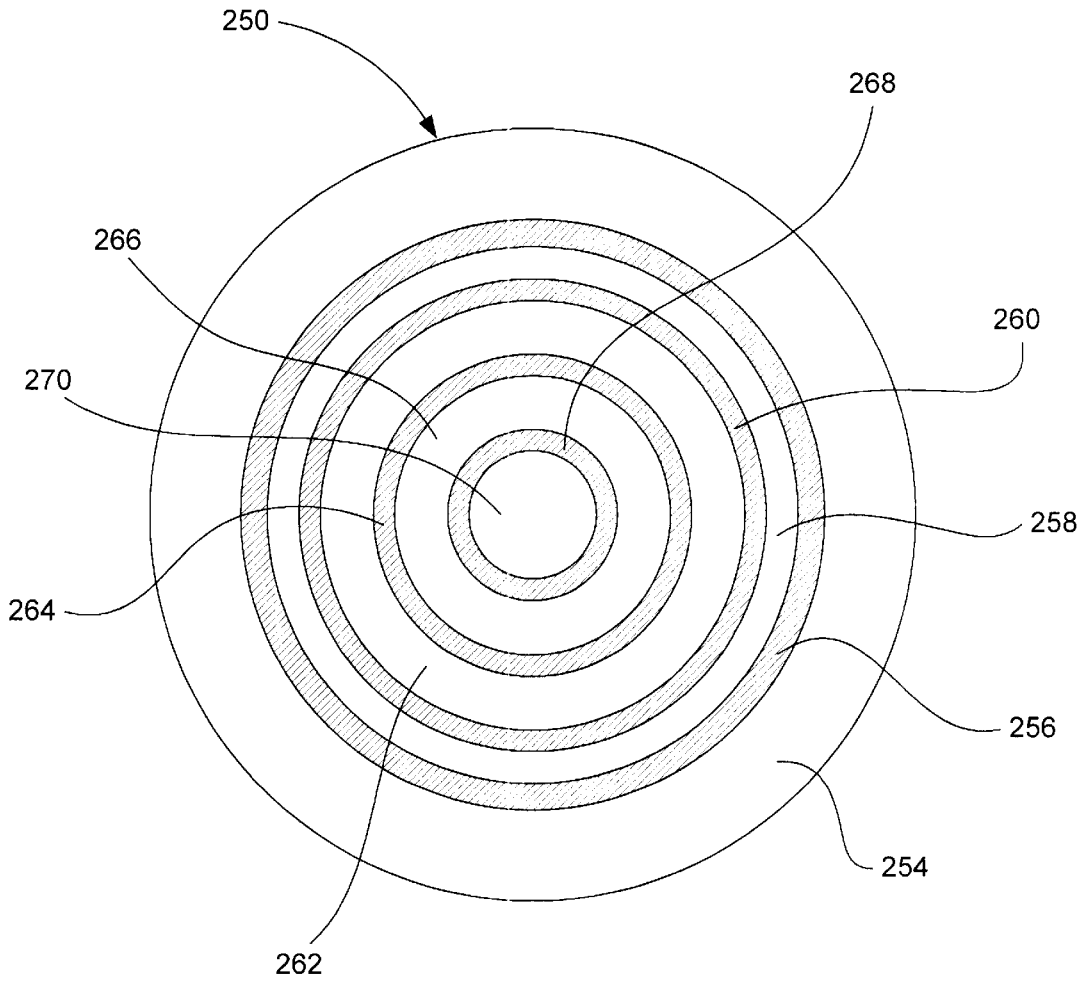
FIG. 3B shows a top view of a polishing pad surface, which is a variation of the polishing pad surface of FIG. 3A, and may also be employed in modem CMP systems.

In another preferred embodiment of the present invention, the polishing pads shown in FIGS. 3A and 3B and described below are employed in modem CMP systems, such as the AvantGaard 676 mentioned above. FIG. 3A shows a polishing pad 200, according to one embodiment of the present invention, having a surface that includes a circular center area 204 disposed towards the center of a polishing pad 20. A ring shaped peripheral area 202 is located outside center area 204. FIG. 3B, which presents a variant of the embodiment of FIG. 3A, shows a polishing pad 250 including a plurality of interior annular areas 256, 260, 264 and 268 that are positioned between a center area 270 and a peripheral area 254. Annular areas 256, 260, 264 and 268 of FIG. 3B are further separated by intermediate annular areas 258, 262, and 266.

The embodiments illustrated in FIGS. 2B and 3B are superficially similar, but embodiments illustrated in FIG. 3B has a smaller central circular area. This is because the wafer spends most of its time near the center of the polishing pad in modern CMP systems. Therefore, in order for the wafer to experience both areas of the polishing pad, the center area should be substantially smaller than the size of the wafer being polished. Those skilled in the art will recognize that the polishing pads of FIGS. 3A and 3B also include slurry injection holes, microgrooves and macrogrooves when the polishing pads are used in modern CMP systems.

The physical properties of the first and second areas shown in FIGS. 3A and 3B are similar to those described in FIGS. 2A and 2B. In other words, the light first areas of FIGS. 3A and 3B may have at least one physical property, e.g., hardness, specific gravity, compressibility, abrasiveness, the height of the polishing area, etc., that is different from that of the dark second areas of FIGS. 3A and 3B. By way of example, center area 204 of polishing pad 200 may be made from a hard polishing pad material and peripheral area 202 is made from a soft polishing pad material.

It is important to keep in mind that the dimensions of the center, peripheral and interior annular areas of this embodiment should be appropriate so that a substantial portion of the rotating, oscillating wafer surface contacts at least two different polishing areas. For a wafer diameter of between about 6 and about 12 inches, the center area of the polishing pad has a diameter that is between about 1 and about 12 inches.

In general, polishing pads should be designed so that for a given duty cycle, any given portion of the wafer spends significant amounts of time on both the first and second areas. Thus, the area where the wafer spends its time should be divided into include significant areas of both the first and second areas. For example, the smaller area of two areas should occupy at least about 10% (more preferably about 25%) of the total pad area of content with the wafer.

Figure 4A:
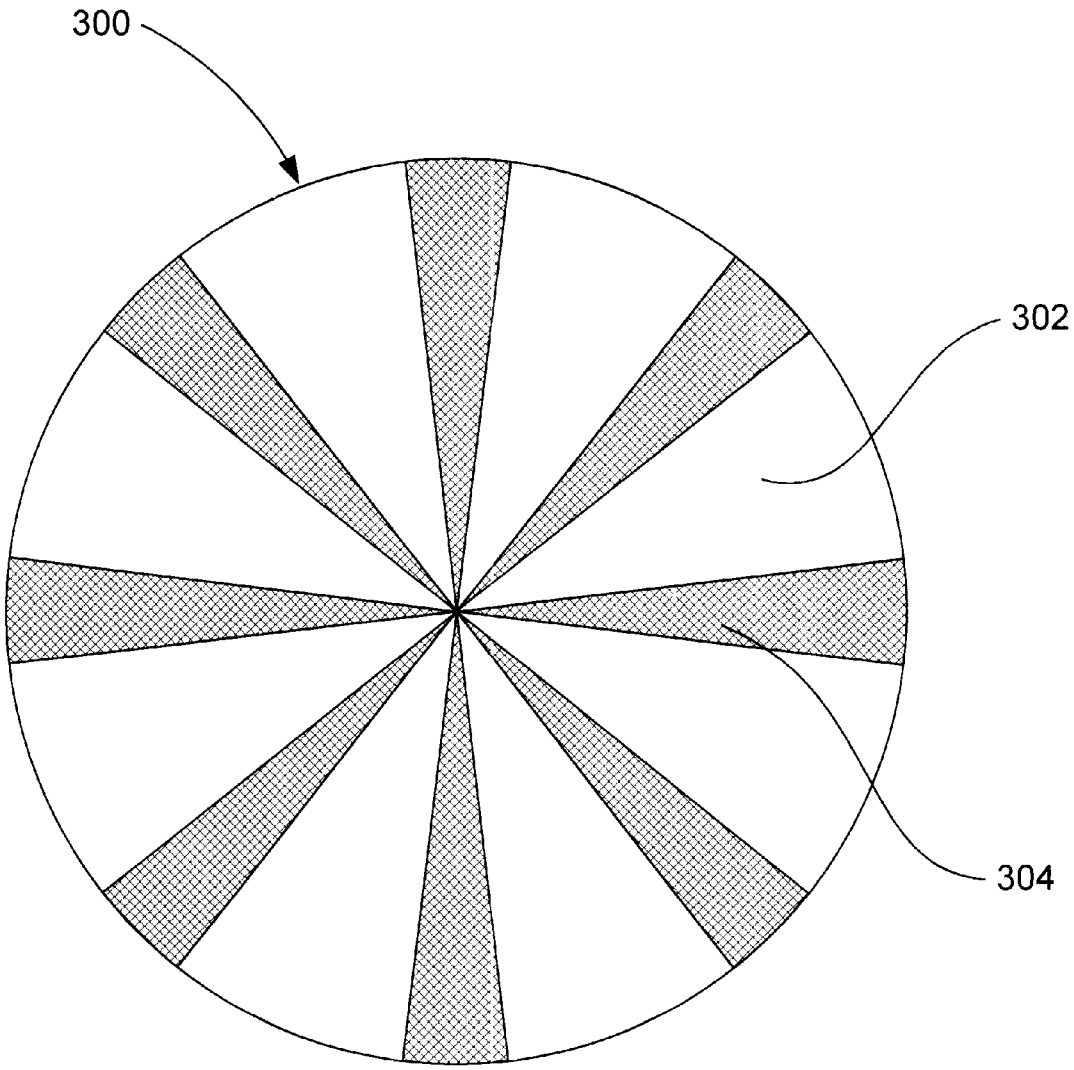
FIG. 4A shows a top view of a polishing pad surface, according to one embodiment of the present invention, that may be employed in both conventional and modem CMP systems.
Figure 4B:
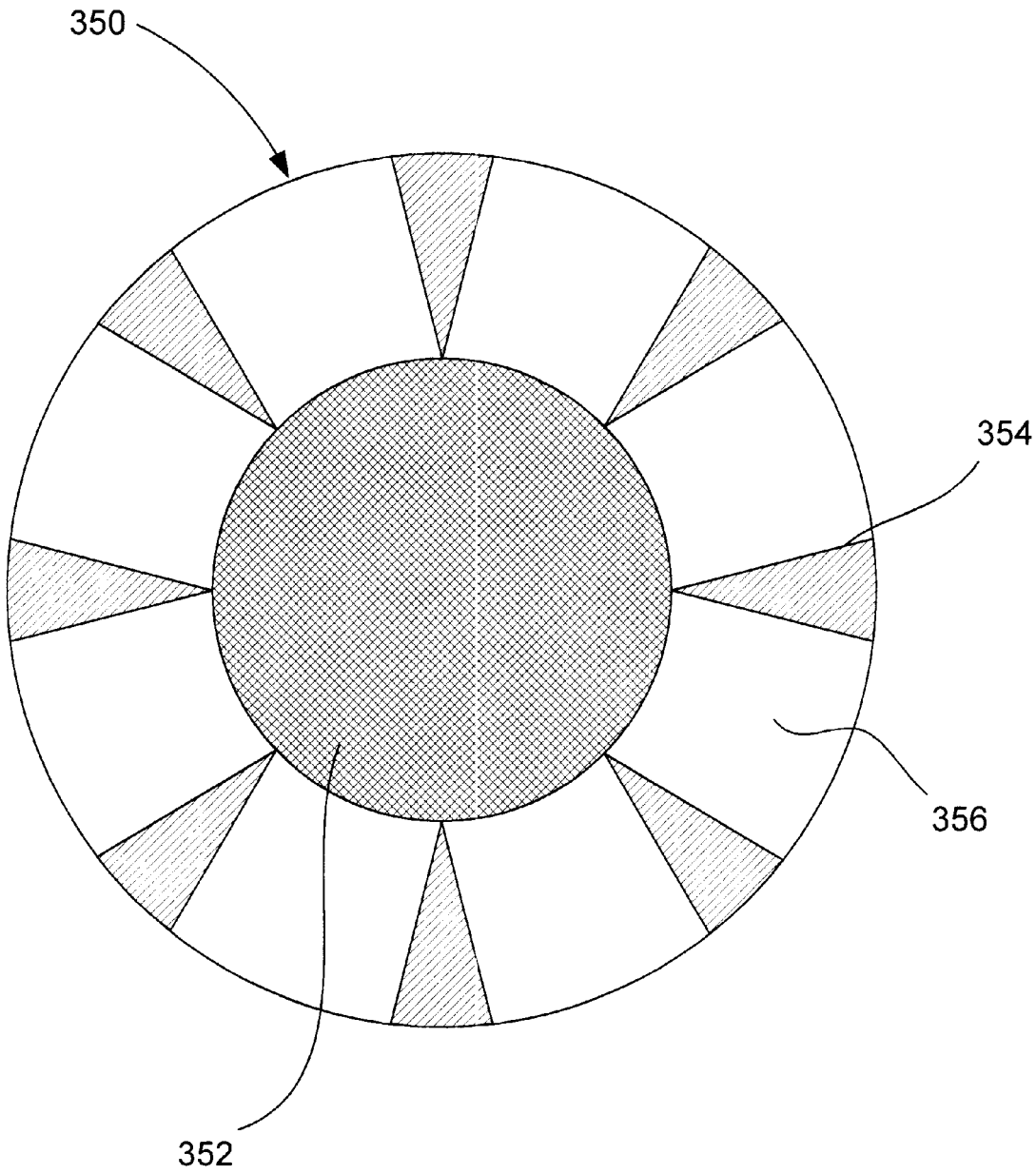
FIG. 4B shows a top view of a polishing pad surface, according to another embodiment of the invention having a variation of the polishing pad surface of FIG. 4A.

FIGS. 4A and 4B show polishing pads that can be employed in both the conventional and modern CMP systems. FIG. 4A shows a polishing pad 300 including sectioned areas 302, between which are disposed elongated areas 304 that extend from a center-point of polishing pad 300 to the edge of the polishing pad like "spokes" of a bicycle wheel. Sectioned areas 302 may have at least one physical property that is different than that of elongated areas 304 or alternatively sectioned areas 302 and elongated areas 304 may be made from different materials. FIG. 4B shows a polishing pad 350 including a center area 352, outside of which has are disposed sectioned areas 356 separated by elongated areas 354. Center area 352 is similar to the center area of FIG. 3A and sectioned areas 356 and elongated areas 354 are similar to the sectioned and elongated areas of FIG. 4A. The polishing pad designs shown in FIGS. 4A and 4B account for the location of high duty cycles on the polishing pads used in the conventional and modern CMP systems. Regardless of whether the a wafer track or an area near the center of the polishing pad experiences a higher duty cycle, a substantial portion of the rotating, oscillating wafer surface in the conventional or modern CMP systems during CMP contact center area 352, elongated areas 354 and sectioned areas 356 of polishing pad 350.

It is important to note that different polishing areas oil the present invention, specifically those areas with different heights, are distinct from microgrooves and macrogrooves on a polishing pad surface. The width of polishing areas of the present invention is generally greater than about 40 mils and preferably the width of such polishing areas is between about 0.08 and about 3 inches and more preferably between about 0.25 and about 3 inches. By way of example, the distance between inner and outer boundaries of annular area 154 may preferably range from between about 0.08 and about 3 inches. In contrast, microgrooves and macrogrooves have a width of between about 15 and about 40 mils. In the embodiments, where the polishing area is not of uniform width, e.g., elongated sections 354 of FIG. 4B, the width of a substantial portion of the polishing area is generally greater than about 40 mils.

A typical CMP process, according to one embodiment of the present invention, begins after securing a wafer on a wafer holder and then positioning the wafer on a polishing pad of the present invention. During CMP, the wafer rotates and oscillates on the polishing pad, which may in turn rotate or orbit around an axis that is perpendicular to the polishing pad surface. In order for a substantial portion of the wafer surface to contact at least two polishing pad areas having at least one different physical property, the wafer oscillates from side to side by a sufficient distance, while contacting polishing pad areas of appropriate dimensions. By way of example, for a wafer diameter of between about 6 inches and about 12 inches, the wafer oscillates generally between about 0.25 and about 12 inches.

Although the foregoing invention has been described in some detail for purposes of clarity of understanding, it will be apparent that certain changes and modifications may be practiced within the scope of the appended claims. For example, while the specification describes introducing the modified pad design in the context of tungsten CMP, there is no reason why in principle the modified polishing pad design cannot be implemented during silicon dioxide CMP or some other type of CMP. Therefore, the present embodiments are to be considered as illustrative and not restrictive, and the invention is not to be limited to the details given herein, but may be modified within the scope of the appended claims.

What is claimed is:

1. A polishing pad for chemical-mechanical polishing of an integrated circuit wafer surface, said integrated circuit wafer surface having a diameter, comprising:

a first polishing area comprising a single wafer contact surface material with a first value of a property selected from a group consisting of pore size, perforations, elastic and shear modulus, hardness, specific gravity, compressibility and abrasiveness; and a second polishing area comprising a single wafer contact surface material with a second value of said property which said second value is different from the first value, such that during chemical-mechanical polishing of an integrated circuit wafer surface, the integrated circuit wafer rotates and oscillates on the, polishing pad so that a substantial portion of the integrated circuit wafer surface contacts both the first and second polishing areas, wherein widths of said first and second polishing areas are substantially less than about the diameter of the integrated circuit wafer.

2. The polishing pad of claim 1, wherein the first polishing area has a greater hardness than the second polishing area.

3. The polishing pad of claim 2, wherein the first polishing area has a rockwell hardness of between about 30 and about 90 Shore A.

4. The polishing pad of claim 1, wherein the first polishing area is more compressible than the second polishing area.

5. The polishing pad of claim 1, wherein the first polishing area has a compressibility that is between about 2 and about 50%.

6. The polishing pad of claim 1, wherein the first polishing area has a specific gravity that is between about 0.6 and about 1.5.

7. The polishing pad of claim 1, wherein the first polishing area includes abrasive particles and the second polishing area does not include abrasive particles.

8. The polishing pad of claim 1, wherein the first and second polishing areas includes at least one material selected from a group consisting of polyurethane, urethane, polymer, polyurethane impregnated felt, abrasive and filler material.

9. The polishing pad of claim 1, wherein the width of said first and second polishing areas is between about 0.08 inches and about 3 inches.

10. The polishing pad of claim 1, wherein the width of said first and second polishing areas is between about 0.25 and about 3 inches.

11. The polishing pad of claim 1, wherein the property is selected from a group consisting of elastic and shear modulus, hardness, specific gravity, compressibility and abrasiveness.

12. A polishing pad for chemical-mechanical polishing of an integrated circuit wafer surface, said polishing pad having an edge and said integrated circuit wafer surface having a diameter, comprising:

a center polishing area disposed towards a center of a surface of the polishing pad and comprising a single wafer contact surface material with a first value of a property selected from the group consisting of pore size, perforations, elastic and shear modulus, hardness, specific gravity, compressibility and abrasiveness;

a peripheral polishing area located at the edge of the polishing pad comprising a single wafer contact surface material with said first value of said property; and a ring shaped polishing area defined by an inner boundary and an outer boundary and located between said center polishing area and said peripheral area, wherein said ring shaped polishing area has a single second contact surface material with a second value of said property which said second value is different from the first value of said peripheral and said center polishing areas and during chemical-mechanical polishing of an integrated circuit wafer surface, the integrated circuit wafer rotates and oscillates on the polishing pad so that a substantial portion of the integrated circuit wafer surface contacts at least said ring shaped polishing area and said peripheral or said center polishing areas, wherein widths of said ring shaped polishing area is substantially less than about the diameter of the integrated circuit wafer.

13. The polishing pad of claim 12, wherein a distance between the outer boundary and the inner boundary of the ring shaped polishing area is less than or equal to a diameter of the integrated circuit wafer surface.

14. The polishing pad of claim 12, wherein the ring shaped polishing area is made from a first polishing pad material and the peripheral and the center polishing areas are made from a second polishing pad material.

15. The polishing pad of claim 10, further comprising an intermediate polishing area and another ring shaped polishing area, wherein said another ring shaped polishing area is disposed between the center polishing area and the peripheral polishing area and said intermediate polishing area separates said ring shaped polishing area and said another ring shaped polishing area.

16. The polishing pad of claim 15, wherein the circular ring shaped polishing area is made from first polishing pad material and the peripheral and the center polishing areas are made from second polishing pad material said intermediate polishing area is made from a third polishing pad material and during chemical-mechanical polishing of the integrated circuit wafer surface, a substantial portion of the wafer surface contacts the first, second and third polishing materials of the polishing pad.

17. The polishing pad surface of claim 12, wherein during CMP the polishing pad and the integrated circuit wafer rotate around an axis that passes through the center of the surface of the integrated circuit wafer so that the integrated circuit wafer is polished on a wafer track, which include at least a portion of said ring shaped polishing area and said peripheral or said center polishing areas.

18. The polishing pad of claim 12, wherein the property is selected from a group consisting of elastic and shear modulus, hardness, specific gravity, compressibility and abrasiveness.

19. A polishing pad for chemical-mechanical polishing of an integrated circuit wafer surface, said integrated circuit wafer surface having a diameter, comprising:

a center polishing area disposed at a center region of said polishing pad and having a single wafer contact surface material with a first value of a property selected from the group consisting of pore size, perforations, elastic and shear modulus, hardness, specific gravity, compressibility and abrasiveness; and a peripheral polishing area located outside said center polishing area and having a single second wafer contact surface material with a second value of said property that is different from said first value of said property of said center polishing area and during chemical-mechanical polishing of an integrated circuit wafer surface, the integrated circuit wafer rotates and oscillates on the polishing pad so that a substantial portion of the integrated circuit wafer surface contacts said center and peripheral polishing areas, wherein the width of said center polishing area is substantially less than about the diameter of the integrated circuit wafer.

20. The polishing pad of claim 19, wherein during CMP the integrated circuit wafer rotates on a polishing pad, which orbits around an axis that is perpendicular to the polishing pad surface, so that the integrated circuit wafer is polished on the polishing pad near a center region, which includes at least a portion of said peripheral and said center polishing areas.

21. The polishing pad of claim 19, wherein the center region has a diameter that is between about 1 and about 12 inches.

22. The polishing pad of claim 19, wherein the property is selected from a group consisting of elastic and shear modulus, hardness, specific gravity, compressibility and abrasiveness.

23. A chemical-mechanical polishing process for polishing an integrated circuit wafer, said integrated circuit wafer surface having a diameter, comprising:

providing a polishing pad including:

a first polishing area having a single wafer contact surface material with a first value of a property selected from the group consisting of pore size, perforations, elastic and shear modulus, hardness, specific gravity, compressibility and abrasiveness; and a second polishing area having a single second wafer contact surface material with a second value of said property which said second value is different from the first value and widths of said first and second polishing areas are substantially less than about the diameter of the integrated circuit wafer, securing said integrated circuit wafer on a wafer holder; contacting an active surface of said integrated circuit wafer face down on said polishing pad; and polishing said active surface such that said integrated circuit wafer rotates and oscillates on said polishing pad so that a substantial portion of the integrated circuit wafer surface contacts both the first and second polishing areas of said polishing pad.

24. The process of claim 23, wherein during said polishing, said wafer oscillates from one side of said wafer to a second side of said wafer by a distance that is between about 0.25 and about 12 inches.

25. The polishing process of claim 23, wherein the property is selected from a group consisting of elastic and shear modulus, hardness, specific gravity, compressibility and abrasiveness.

* * * * *